United States Patent [19]

Whitcraft

[11] 4,208,743

[45] Jun. 24, 1980

[54] MOTHER'S GOWN WITH NURSING APERTURES

[76] Inventor: Loni S. Whitcraft, 308 Janet Rd., Reisterstown, Md. 21136

[21] Appl. No.: 38,392

[22] Filed: May 14, 1979

[51] Int. Cl.[2] ..... A41D 1/20

[52] U.S. Cl. ..... 2/104

[58] Field of Search ..... 2/104, 105, 106; 128/482, 460

[56] References Cited

U.S. PATENT DOCUMENTS

| | | | |
|---|---|---|---|
| 1,013,778 | 1/1912 | Jacoby | 2/104 |
| 3,611,439 | 10/1971 | Meyers | 2/104 |

FOREIGN PATENT DOCUMENTS

| | | | |
|---|---|---|---|
| 21434 | 9/1919 | United Kingdom | 2/108 |

*Primary Examiner*—Werner H. Schroeder
*Attorney, Agent, or Firm*—Walter G. Finch

[57] ABSTRACT

The invention is an improved gown for mothers that need to nurse their baby without partially disrobing. The gown is provided with two apertures, one on each side, essentially under each arm. The apertures are so located that either breast can be exposed easily for nursing a child. An inside panel is so arranged on each side so as to completely cover the apertures so that the breasts or any part of the body cannot be seen while wearing the gown. The location of the apertures are such that the mother can insert both hands at the same time to open a nursing type brassiere, in preparation for nursing a child, without opening the gown or otherwise exposing the body in any way.

10 Claims, 4 Drawing Figures

MOTHER'S GOWN WITH NURSING APERTURES

BACKGROUND AND SUMMARY OF THE INVENTION

The invention relates to women's gowns and particularly to gowns worn by mothers that nurse their babies. Specifically, the invention relates to a gown used for nursing that does not need to be unhooked, untied, unzipped, or in any way opened as in a partial disrobing in order to expose a breast so that a child may be nursed.

A need has existed for a long time for a gown for mothers that would permit them to expose a breast to nurse a baby without opening the front of the gown or in any way partially disrobe. The need has also existed for a gown in which the mother could wear a brassiere, but could also open that brassiere in order to expose a breast for nursing without opening the dress in any way in order to open the brassiere. This invention provides such a gown.

In the prior art, gowns had to be opened in front in order to unfasten a brassiere to expose a breast to nurse a child. Some attemtps to have a frontal opening to expose a breast still required the opening of the gown to unfasten the brassiere or to go without a brassiere. The frontal opening was uncomfortable when the breast was exposed.

In reference to the brassiere mentioned hereinbefore, nursing brassieres that may be opened from the front are usually worn by mothers so that the breasts may be easily exposed for nursing.

The present invention permits such brassieres to be unfastened conveniently without the need for first opening the front of the gown to reach the brassiere fastening means. In the prior art, a mother had to either open the brassiere or go without wearing a brassiere. The present invention eliminates these problems.

In referring to a gown hereinabove, it is to be understood that the gown may be in any range of styles or designs from a fashionable type formal evening gown, a cocktail type dress, an dress for everyday wear, to an ordinary house dress. In a similar manner the invention may also be incorporated into a blouse or shirt-type bodice that is worn with a skirt. The drawings hereinafter described show a gown, however, the invention is incorporated in the bodice portion of the gown. The use of the invention in a blouse or shirt type bodice may be envisioned by considering the skirt portion of the illustrated gown as a separate skirt. In effect, all are a form of mother's garment.

Any color or combination of colors may be used in fabricating the gown of this invention, though flowered prints, paisleys, and similar designs may be preferred.

It is, therefore, an object of the invention to provide a gown for a mother that permits nursing a baby while wearing the gown.

It is another object of the invention to provide a gown for a mother that has convenient means for nursing a baby concentrated in the bodice portion of the gown.

It is also an object of the invention to provide a nursing means in a gown that is suitable for use in a blouse-type bodice.

It is yet another object of the invention to provide a nursing gown within which the mother can insert both hands to unfasten a front fastening brassiere without opening the front of the gown.

It is still another object of the invention to provide a gown used for nursing a baby that does not need to be unfastened at the front, exposing parts of the body, other than the breast used for nursing the child.

It is also yet another object of the invention to provide a gown used for nursing a baby which may be designed in any style.

Further objects and advantages of the invention will become more apparent in the light of the following description of the preferred embodiments.

DESCRIPTION OF THE PREFERRED EMBODIMENTS

Figure 1:
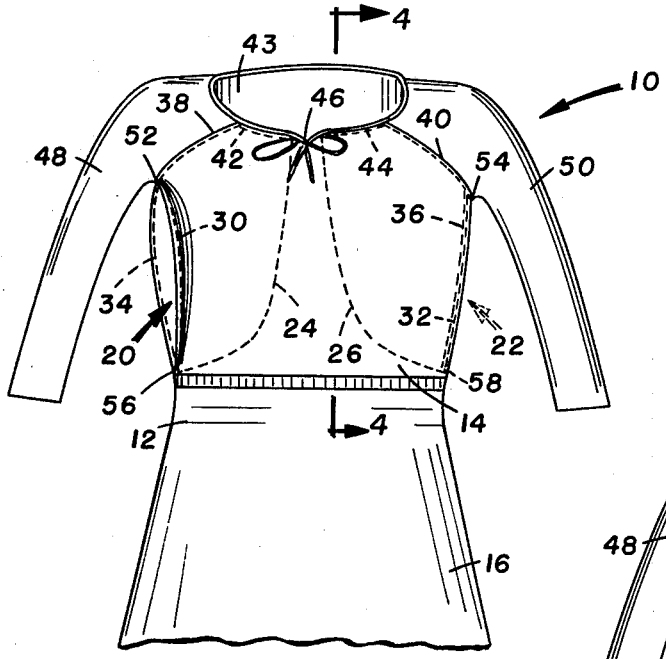
FIG. 1 is a front view of a mother's gown with nursing apertures.

Referring to the drawings and particularly to FIG. 1, an improved mother's gown with nursing apertures is shown at 10.

The mother's gown 10 has the usual parts of women's apparel: the overall gown 12 with a bodice (or blouse portion) 14, and a skirt portion 16. The overall gown 12 has a waistline 18, sleeves 48 and 50, and an opening for the neck 43. The normal center-front opening 46 of the gown 12 may be the same design as that in any female apparel. However, the mother's gown 10 may be made without a center-front opening 46 and be buttoned or zippered down the back (not shown and not numbered).

Thus, the mother's gown 10 has all the usual features of a fashionable and stylish gown 12; the special aspects of the mother's gown 10 that sets it apart from the ordinary gown 12 are described hereinafter.

It is to be especially noted that the mother's gown 10 may be made in any comparable style and design as any evening gown, cocktail dress, daytime dress, or house dress, in general it may be said to be a mother's garment. In that regard it may have a center-front opening 46 or be closed and zippered, buttoned, hooked, or otherwise closed at the back. In fashionable type apparel the back may even be left open. Furthermore, the mother's gown 10 may be made with sleeves 48 and 50 of any length, or even made sleeveless. This wide variety of application of the usual features of a gown 12 to the mother's gown 10 is not possible in the prior art.

A further feature of the mother's gown 10 concept used in the bodice 14 is that the same can be used in a blouse or shirt-like piece of apparel that is then worn with a separate skirt or slacks. Thus, it may be said that the mother's gown 10 is a mother's garment including all of these variations.

Returning now to FIG. 1, the nursing aspects of the mother's gown 10 consist of two nursing apertures 20 and 22, one on each side of the mother's gown 10. The nursing aperture 20 for the right breast and the nursing aperture 22 for the left breast; and two closure panels 24 and 26, one on each side of the mother's gown 10. The right closure panel 24 to close the right nursing aperture 20, and the left closure panel 26 to close the left nursing aperture 22.

The right nursing aperture 20 has a seam 30 around the frontal side or frontal half of the nursing aperture 20. The nursing aperture 20 has a seam 34 around the back side or rear half of the nursing aperture 20 at the point where the vertical side seam of the dress interfaces with the rear half of the nursing aperture 20. In other words, the rear half of the nursing aperture coincides with the side seam of the mother's gown 10. This seam 34 around the rear half of the nursing aperture 20 also picks up and includes the side portion of the right closure panel 24, thus sewing it fast at the rear half of the nursing aperture 20.

It is to be noted that the right closure panel 24 extends slightly below 56 the bottom or lower point of the nursing aperture 20. Essentially, this closure panel slightly below 56 of the nursing aperture 20 also locates it slightly below the waistline 18 as hereinafter described.

The right nursing aperture 20 extends at the top from the armpit juncture 52 of the right sleeve 48 with the bodice portion 14 of the mother's gown 10, to the bottom of the nursing aperture 20 at the waistline 18.

Continuing now with the fastening of the right closure panel 24 to the mother's gown 10, the upper or top edge of the closure panel 24 follows and coincides with the frontal seam 38 of the raglan-type sleeve 48 where it is attached to the bodice portion 14 of the mother's gown 10. It is to be noted that if a set-in type sleeve is used instead of a raglan-type sleeve, the closure panel 24 is then sewed to the inside of a one-piece front panel of the bodice portion 14, or to the front edge of the shoulder panel (if that be the design) along essentially the same configuration line as would have been taken by a raglan-type sleeve seam. An alternative to the latter design is where a yoke-type panel is used at the top of the bodice 14, in that case the seam of the yoke may be used unless the yoke is too low.

The upper or top edge of the closure panel 24 then follows and coincides with the frontal seam 42 of the neckline to the center-front opening 46 and along at least a short portion of any such center-front opening 46. It is to be noted that if the mother's gown 10 has a closed front (no center-front opening 46), the fastening of the closure panel 24 to the mother's gown 10 would end at the center of the neckline.

Thus, the right front closure panel 24 is fastened to the mother's gown 10, beginning just below the waistline 18 at the side seam (not numbered) and continuing along and coinciding with the interface of the gown side seam and the rear half of the nursing aperture 20 at the seam 34, then along the frontal seam 38, then along the neckline seam 42 to the center of the neckline, all as hereinbefore described.

Figure 2:
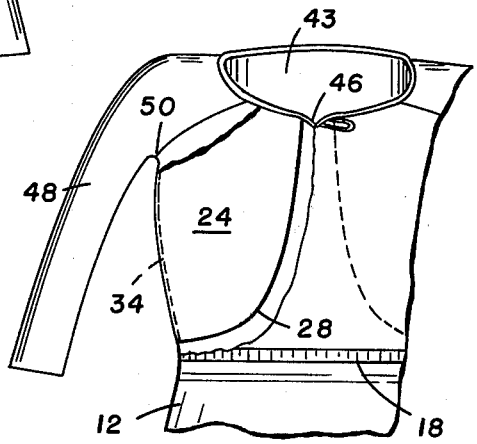
FIG. 2 is a partial view of the bodice portion of a mother's gown showing the inside closure panel covering for a nursing aperture.

The entire lower or bottom edge 28 of the closure panel 24 as seen in FIG. 2 hangs free and is not in any way attached or sewed to the mother's gown 10. This lower edge is configured in a large sweeping arc, as illustrated, from the point of attachment 56 below the waistline 18 to the aforementioned attachment at the center of the neckline at seam 42.

In a like manner, the left closure panel 26 is a mirror image of the right closure panel 24 and is fastened to the mother's gown 10: starting below the waistline 18 at juncture of the side seam and the lower point 58, along the seam 36 at the rear half of the left nursing aperture 22, along the frontal seam 40, and then along the neckline seam 44 to the center of the neckline as hereinbefore described for the right closure panel 24.

The left nursing aperture 22 is a mirror image of and similar to the right nursing aperture 20, having a frontal seam 32 and extending from the armpit juncture 54 to the waistline 18.

Figure 3:
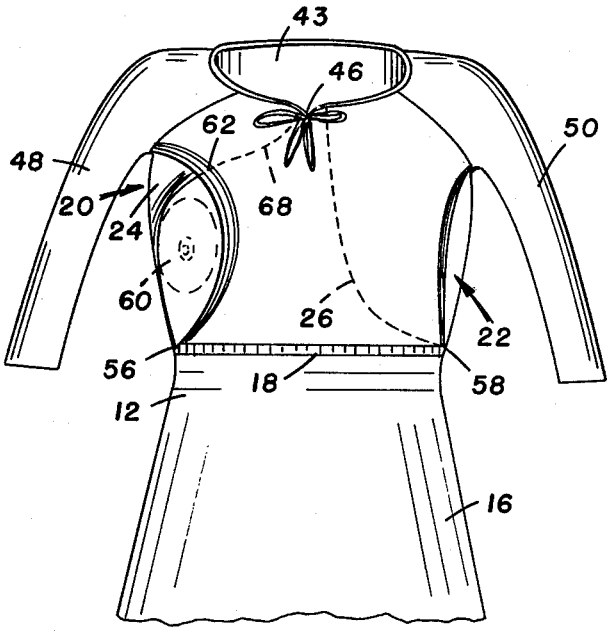
FIG. 3 is a partial view of a mother's gown showing a breast exposed through one of the nursing apertures.
Figure 4:
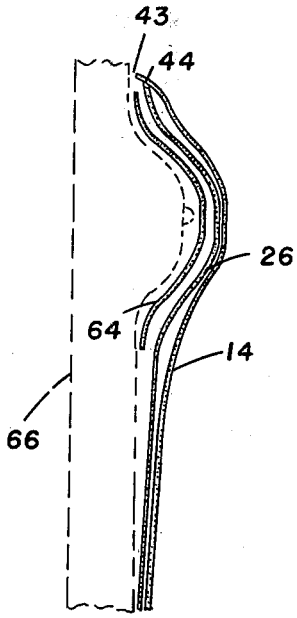
FIG. 4 is a partial sectional view on line 4—4 of FIG. 1

Turning now to FIGS. 3 and 4 regarding the method for exposing either the left or right breast for nursing a baby, the right breast 60 is shown exposed through the right nursing aperture 20. To expose the breast 60 the frontal edge of the nursing aperture 20 is pulled forward and slightly toward the center of the body to a more or less folded configuration 62. At the same time, the right closure panel 24 is lifted over the breast somewhat along the line 68 in FIG. 3.

The manner in which the closure panels 24 and 26 extend straight downward on the inside of the bodice portion 14 can be seen in FIG. 4. In FIG. 4 the closure panel 26 can be seen fastened to the bodice portion 14 at the neckline seam 44. A portion of the mother's body 66 is illustrated to show the neck extending through the neck opening 43 and a brassiere 64 around the breast of the mother. The parts of the mother's gown 10, the closure panel 26 and the bodice 14 are shown spaced apart from the body 66 for clarity. These parts would essentially be next to and interfacing with the body 66.

The exposure of the breast 60 described hereinbefore was essentially as if the mother was not wearing a brassiere 64. However, the procedure for exposing the breast 60 if wearing a brassiere 64 is exactly the same, except that the brassiere 64 must first be unfastened at the front (usually a nursing mother wears a front-fastening type of brassiere).

One of the major features of the present invention is the ease with which the brassiere 64 can be opened without opening the front of the mother's gown 10 (or a comparable blouse) or in any way partially disrobing.

In the present invention, the mother can insert a hand into each of the two nursing apertures 20 and 22 to the location of the fastening for the brassiere 64 conveniently unfasten it so that both breasts can be exposed individually through the respective nursing apertures 20 or 22. This convenience and facility is not possible in the prior art.

Another factor is that the exposure of the breast 60 through the side nursing aperture 20 (or for the other breast through nursing aperture 22) places the breast in a convenient position so that a nursing child can be held comfortably across the body, particularly as the child grows in length. In the prior art the exposed breast is closer to the center of the body and larger children must be held uncomfortably to one side in order to permit the child to nurse at the breast.

When the mother's gown 10 is not being worn, the nursing apertures 20 and 22 appear as an elongated fold or pleat under the arm. When the mother's gown 10 is worn by a mother, the breasts extend the bodice portion 14 forwardly and the frontal edge of the nursing apertures 20 and 22 move forward slightly. As this movement takes place the closure panels 24 and 26 cover the slight opening of the nursing apertures 20 and 22 as the breasts are in back of the closure panels 20 and 22. The vertical lines of the nursing apertures 20 and 22 blend into the folds and pleat lines of the garment and essentially unnoticeable, a distinct feature not found in the prior art.

Thus, the mother's gown 10 appears to be an ordinary gown, dress, or blouse and skirt combination when worn, but has the convenience of being able to unfasten the brassiere 64 and expose a breast 60 without any unfastening of any part of the mother's gown 10. Furthermore, an exposed breast 60 is in a more comfortable position for nursing a child than the prior art permits.

As can be readily understood from the foregoing description of the invention, the present structure can be configured in different modes to provide the ability to expose a breast and nurse a child.

Accordingly, modifications and variations to which the invention is susceptible may be practiced without departing from the scope and intent of the appended claims.

What is claimed is:

1. A nursing gown, comprising, a mother's garment having two nursing apertures for exposing the breasts to nurse a child without unfastening any part of said garment, said mother's garment having at least a bodice portion with armpits, a waistline, a neckline, and side seams, said garment having a first aperture provided in the right side thereof, said first aperture extending vertically from the armpit of said garment to the waistline of said garment;

said garment having a second aperture provided on the left side thereof, said second aperture extending vertically from the armpit of said garment to the waistline of said garment;

a first closure panel affixed to the inside of said garment, said first closure panel being attached vertically to the rearward side of said first aperture and suitably attached across the upward side to the inside of said garment and thence along a frontal neckline of said garment at least to the center of said garment, the lower edge of said first closure panel being unattached to any part of said garment; and a second closure panel affixed to the inside of said garment, said second closure panel being attached vertically to the rearward side of said second aperture and suitably attached across the upward side to the inside of said garment and thence along a frontal neckline of said garment at least to the center of said garment, the lower edge of said second closure panel being unattached to any part of said garment.

2. A nursing gown as recited in claim 1, wherein said rearward sides of said first and second apertures coincide with said side seams of said garment.

3. A nursing gown as recited in claim 1, wherein the rearward bottom edge of said first and second closure panels extend slightly below said waistline, the entire bottomward edge of each of said first and second closure panels being configured as an arc extending from said rearward bottom edge to the point of attachment of said first and second closure panels at the frontal neckline at the center of said garment.

4. A nursing gown as recited in claim 1, wherein said first and second closure panels cover said first and second apertures, respectively, as apertures open slightly when said garment is worn and said mother's breasts expand the front part of the garment forwardly.

5. A nursing gown as recited in claim 1, wherein said garment is a fashionable gown.

6. A nursing gown as recited in claim 1, wherein said garment is a dress.

7. A nursing gown as recited in claim 1, wherein said garment is a blouse.

8. A nursing gown as recited in claim 4, wherein said first and second apertures expand to permit entry of the mother's hands to unfasten a brassiere to permit the breasts to be exposed through said apertures for nursing a child.

9. A nursing gown as recited in claim 2, wherein the frontal side of said first and second apertures may be moved forward to permit exposure of a breast on the respective sides of said apertures.

10. A nursing gown as recited in claim 9, wherein said first and second closure panels may be raised upwardly to permit passage of the respective breast for exposure through said first and second apertures.

* * * * *